US005525039A

United States Patent [19]

Sieghartner

[11] Patent Number: 5,525,039

[45] Date of Patent: Jun. 11, 1996

[54] HERMETICALLY SEALED MAGNETIC DRIVE PUMP

[75] Inventor: Leonard J. Sieghartner, Coal Valley, Ill.

[73] Assignee: Roy E. Roth Company, Rock Island, Ill.

[21] Appl. No.: 95,271

[22] Filed: Jul. 21, 1993

[51] Int. Cl.[6] ..... F04B 49/10; F04B 17/00

[52] U.S. Cl. ..... 417/32; 417/244; 417/420; 417/423.11; 417/423.12; 417/423.13; 417/423.14

[58] Field of Search ..... 417/32, 244, 420, 417/423.11, 423.12, 423.13, 423.14

[56] References Cited

U.S. PATENT DOCUMENTS

| | | | |
|---|---|---|---|
| 3,764,236 | 10/1973 | Carter | 417/423.12 |
| 4,932,848 | 6/1990 | Christensen | 417/423.13 |
| 4,943,208 | 7/1990 | Schoenwald | 417/244 |
| 4,990,057 | 2/1991 | Rollins | 417/32 |
| 5,137,418 | 8/1992 | Seighartner | 415/55.1 |
| 5,201,642 | 4/1993 | Hinckley | 417/420 |
| 5,248,245 | 9/1993 | Behnke et al. | 417/420 |
| 5,334,004 | 8/1994 | Lefevre et al. | 417/420 |
| 5,368,446 | 11/1994 | Rode | 417/32 |

FOREIGN PATENT DOCUMENTS

| | | | |
|---|---|---|---|
| 0010464 | 4/1980 | France | 417/32 |
| 405052196 | 3/1993 | Japan | 417/32 |

*Primary Examiner*—Richard A. Bertsch
*Assistant Examiner*—Xuan M. Thai
*Attorney, Agent, or Firm*—Emrich & Dithmar

[57] ABSTRACT

A pump assembly is disclosed having a housing including a suction inlet and a discharge outlet and a pump assembly contained within the housing. The pump assembly includes a pumping stage and a driving stage, with the pumping stage including an impeller assembly constructed and arranged to impart regenerative action flow to the fluid being pumped. The driving stage includes a magnetic drive comprised of a drive magnet and a driven magnet associated with a shaft operatively coupled to the impeller assembly, with the driven magnet positioned with in a sealed containment vessel. A portion of the pumped liquid is circulated as a coolant through the containment vessel and returned to the pumping stage. A control assembly is provided to monitor the differential temperature of the magnetic drive and the bearing structure within the magnetic drive to control operation of the pump assembly.

23 Claims, 6 Drawing Sheets

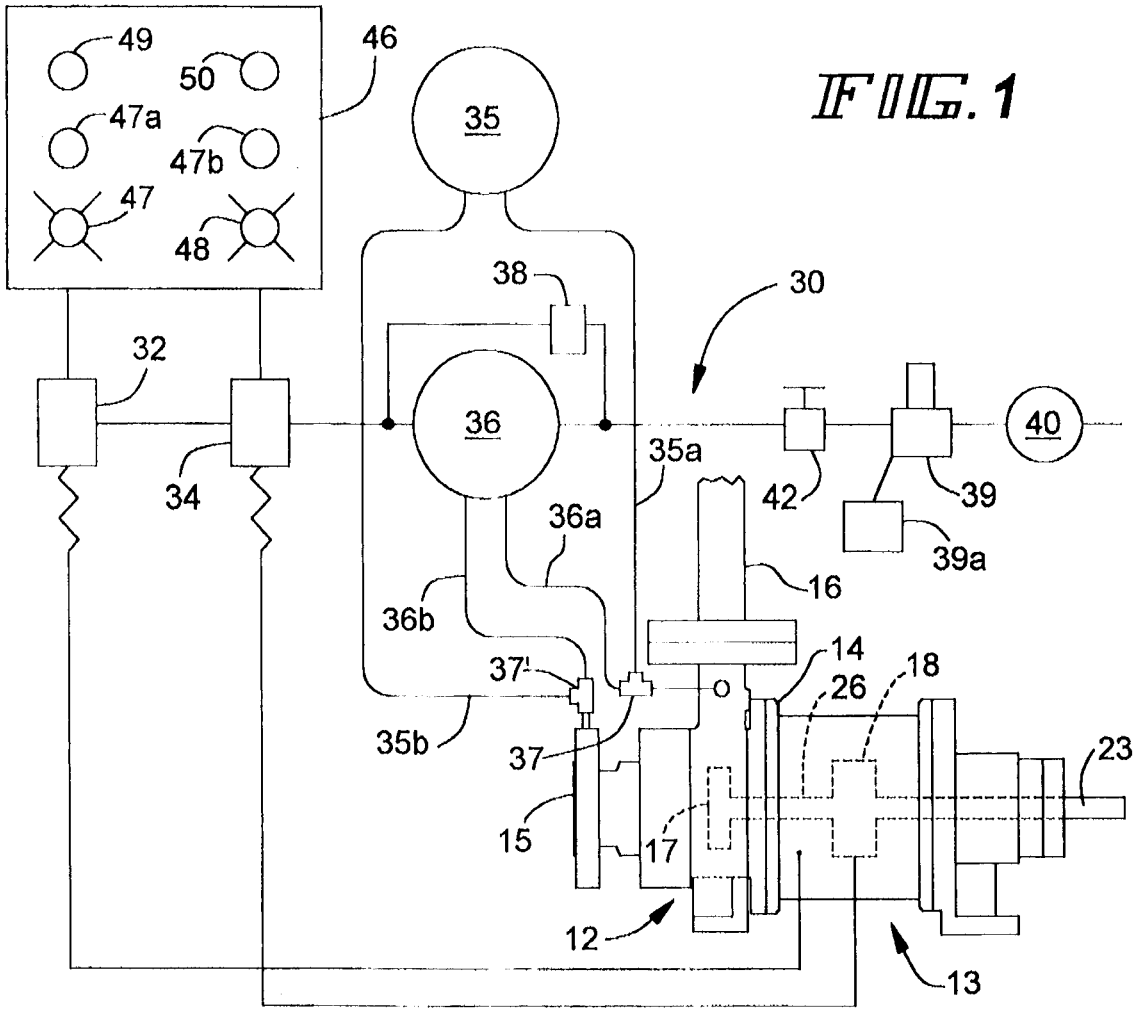
FIG. 1
FIG. 2
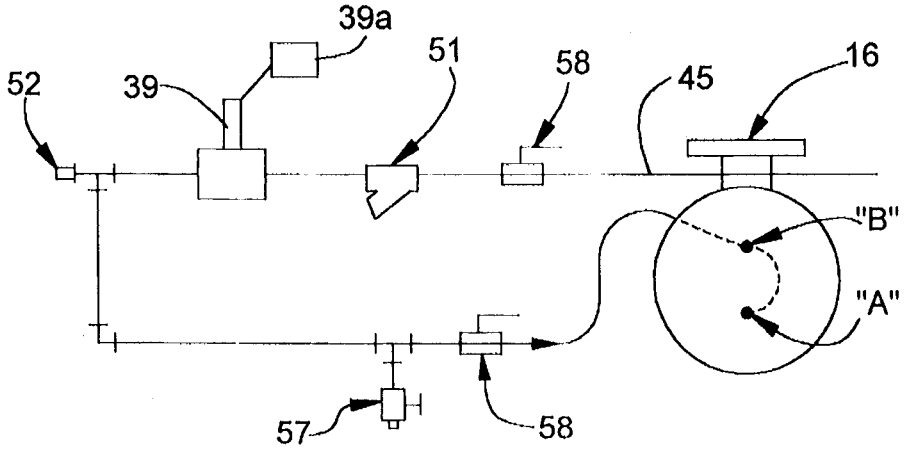

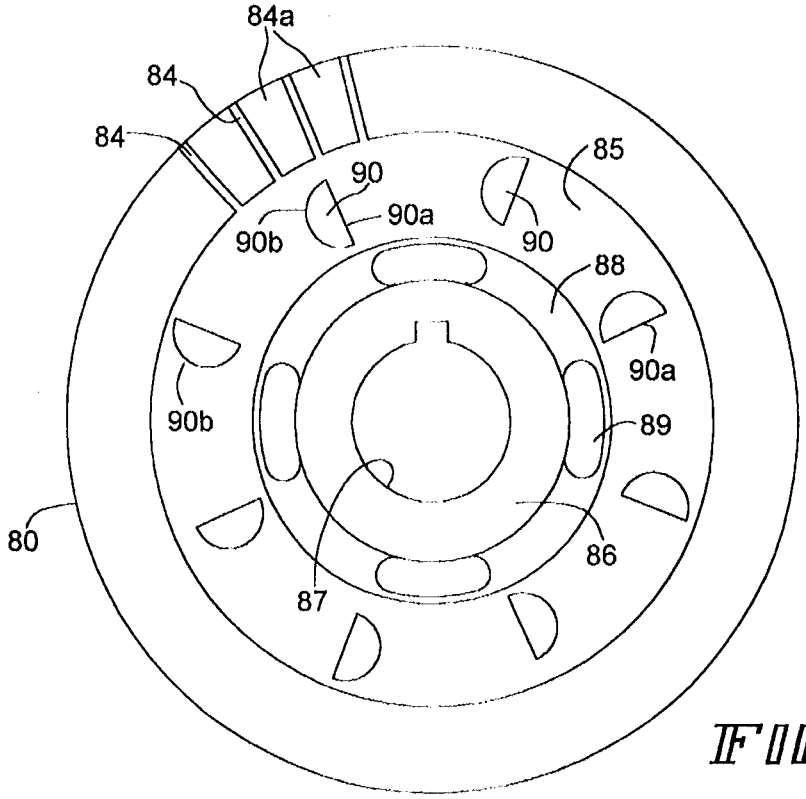
FIG. 4
FIG. 4A
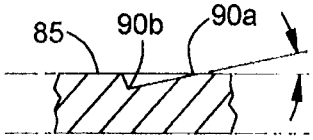
FIG. 5
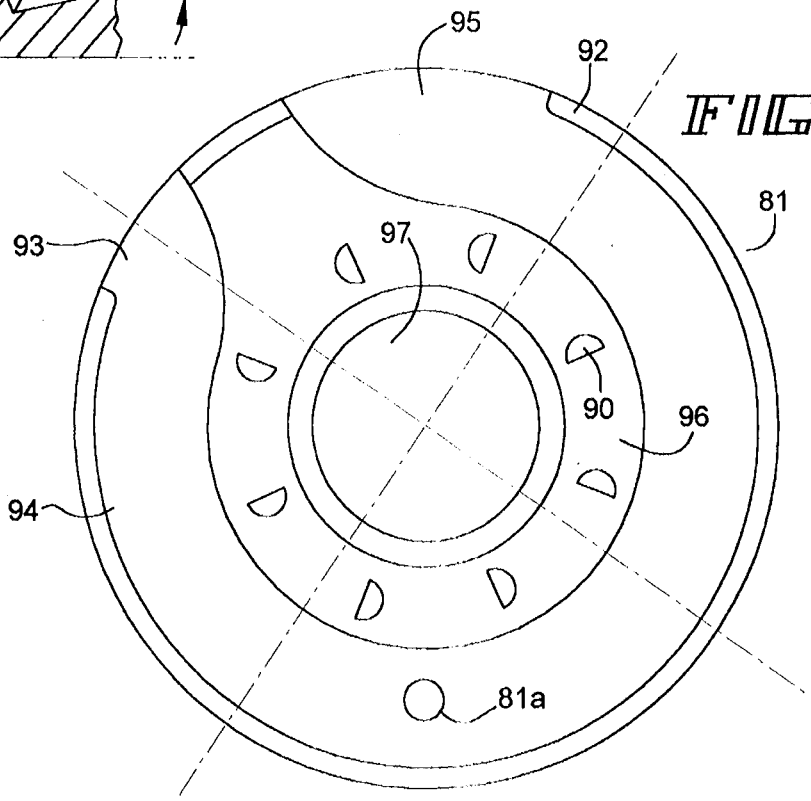

HERMETICALLY SEALED MAGNETIC DRIVE PUMP

BACKGROUND OF THE INVENTION

This invention relates to pumps for continuous high pressure pumping of noxious liquids and liquid gases, and more particularly, to a hermetically sealed magnetic drive pump having condition responsive control.

The continuous pumping of gases in liquid phase, organic fluids, noxious liquids and other volatile liquids, requires high pressure pumping processes. Examples of such volatile liquids include propane, ammonia, and ethanol. Volatile liquids must be confined under pressure or they will vaporize resulting in vapor lock of the pump. Therefore, a high discharge pressure must be maintained to provide a constantly liquid filled pump in operation. To aid in maintaining a high discharge pressure and to prevent vaporization of the processed liquid, pumps are designed with the low NPSM and high head characteristics of the regenerative turbine pump combination.

A further consideration is that protection must be provided against environmental hazards, particularly when potentially hazardous fluids, such as propane and ammonia, are being pumped. It is becoming common practice to provide secondary containment for pumps designed to pump volatile liquids to guard against the occurrence of a hazardous condition. One way to accomplish secondary containment in such pumps is to employ a hermetically sealed magnetic drive for the pump and to enclose the sealed magnetic drive within a housing. Such pumps are commonly referred to as "canned" magnetic drive pumps. Because the hermetically sealed magnetic drive of the pump is sealed within a containment vessel, the heat generated tends to build up within the containment vessel. The heat is generated by moving parts, such as, bearing which are contained within the containment vessel. In addition, the relative motion of the driving magnet and the driven magnet of the magnetic drive and the containment vessel produces eddy currents in the containment vessel, resulting in heat build-up. The heat must be dissipated to prevent damage to the magnetic drive.

Various cooling arrangements have been proposed for canned magnetic drive pumps. Typically, heat build-up is minimized by directing a portion of the liquid at the high discharge pressure through the containment vessel as a coolant or heat transfer medium to remove heat from the interior of the containment vessel. Conventionally, the liquid is returned to the suction inlet of the pump to be recirculated through the pump. However, because the liquid is heated as it is circulated through the containment vessel, the possibility exists that the high pressure liquid being returned to the section inlet for recirculation will "flash" into vapor at the low pressure suction inlet. Moreover, although circulation of a portion of the processed fluid through the containment vessel reduces heating within the containment vessel, under some conditions, the coolant flow may not provide adequate cooling, or coolant flow may be interrupted for some reason, resulting in overheating and possible damage to the pump assembly and in particular to the magnetic drive for the pumping stage.

A further shortcoming of this heat transfer method is that the liquid that is circulated through the containment vessel picks up contaminants, including magnetic particles and metal, which are reintroduced into the flow stream at the suction inlet. Such contaminants will be circulated through the pumping stage and may cause damage to the pump stage and the magnetic drive bearings.

SUMMARY OF THE INVENTION

It is an object of the invention to provide an improved magnetic drive pump assembly for high pressure processes.

Another object of the invention is to provide a pump assembly for high pressure processes, the operation of which is controlled as a function of operating conditions of the pump assembly.

Yet another object of the invention is to provide a high pressure magnetic drive pump assembly which provides secondary containment for the processed fluid.

Another object of the invention is to provide a high pressure magnetic drive pump assembly in which a portion of the processed fluid is circulated through the magnetic drive, and which is characterized by an improved coolant flow arrangement.

A further object of the invention is to provide an improved multistage magnetic drive pump assembly for high pressure processes.

Another object of the invention is to provide a magnetic drive pump which achieves a low positive suction head requirement.

The present invention provides a pump assembly including a pump stage and a magnetic drive stage for the pump stage. The pump stage, which can be single stage or multiple stage, includes a generative turbine impeller means which is adapted to increase the discharge pressure of the processed liquid. The impeller means includes a floating self-centering impeller and an enclosing means which encloses the impeller so as to impart regenerative turbine flow to the processed or pumped liquid resulting in increased discharge pressure. The pump assembly produces a high differential pressure head which provides sufficient margin above vapor pressure to ensure that the processed liquid is maintained in liquid phase to provide a constantly liquid filled pump in operation so as to avoid dry-run and damage to the pump and bearing structure. In one embodiment of a pump assembly provided by the present invention, the pump stage includes a booster impeller means at the suction inlet stage of the pump assembly and, upstream of the regenerative turbine impeller means, the booster impeller means cooperates with the regenerative turbine impeller means to further increase the discharge pressure of the processed liquid and achieve a low net positive suction head.

The magnetic drive stage is contained within a containment vessel and has a driven magnet coupled to an output shaft which is coupled to the boaster and regeneration impellers of the pump stage for rotating the impeller means. The magnetic drive stage includes a driving magnet which is coupled to a drive shaft by which the driving magnet is rotated. The pump stage and the canned magnetic drive stage are enclosed within a housing which is sealed except for the opening through which the drive shaft extends. Secondary containment is obtained by a sealing means for the drive shaft which is constructed and arranged to protect against environment hazard in the event of an over pressure condition in the containment vessel of the magnetic drive stage.

A portion of the processed or pumped liquid at the high discharge pressure is circulated as a coolant through the containment vessel. The liquid contacts the containment vessel and the bearings for the magnetic drive stage and is returned to the pump stage. The liquid both cools and lubricates components of the magnetic drive stage of the pump assembly. In accordance with a feature of the present invention, the liquid is reintroduced into the flow stream at a location that is between the high pressure discharge outlet and the low pressure inlet. In accordance with a disclosed embodiment, the liquid is reintroduced at a location where the pressure of the processed liquid is approximately one-half the differential pressure and suction pressure. Further in accordance with the present invention, a filtering means is provided in the flow path for the liquid which is circulated through the containment vessel as a coolant for filtering the liquid to remove contaminants from the liquid to prevent damage to the magnetic drive system. Additionally, a magnetic plug means is provided in the flow path for the liquid which is circulated through the containment vessel as a coolant for separating the magnetic or metal containments from the liquid to prevent damage to the magnetic drive system.

Further in accordance with the invention, the pump assembly includes a control system which monitors conditions within the magnetic drive stage and controls the operations of the pump. The pump is shut down automatically in the event that the differential pressure between the discharge outlet and the suction inlet decreases below a set point or predetermined value. In addition, the operation of the pump is stopped if the temperature of the can and/or of the bearings of the magnetic drive exceeds a set point or predetermined value.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For purposes of facilitating an understanding of the invention, there is illustrated in the accompanying drawings a preferred embodiment thereof, from an inspection of which, when considered in connection with the following description, the invention, its construction and operation, and many of its advantage will be readily understood and appreciated.

FIG. 1 is a simplified representation of the magnetic drive pump assembly provided by the present invention and illustrating the control system of the pump assembly;

FIG. 2 is a simplified representation of the magnetic drive pump assembly of FIG. 1, illustrating the lubrication and coolant flow circuit of the control system;

FIG. 4 is an end view of the impeller of the magnetic drive pump assembly provided by the present invention;

FIG. 4A is a sectional view taken along the line 3A–4A of FIG. 4;

FIG. 5 is an end view of one of the end plates of the magnetic drive pump assembly provided by the present invention;

DESCRIPTION OF A PREFERRED EMBODIMENT

Figure 3:
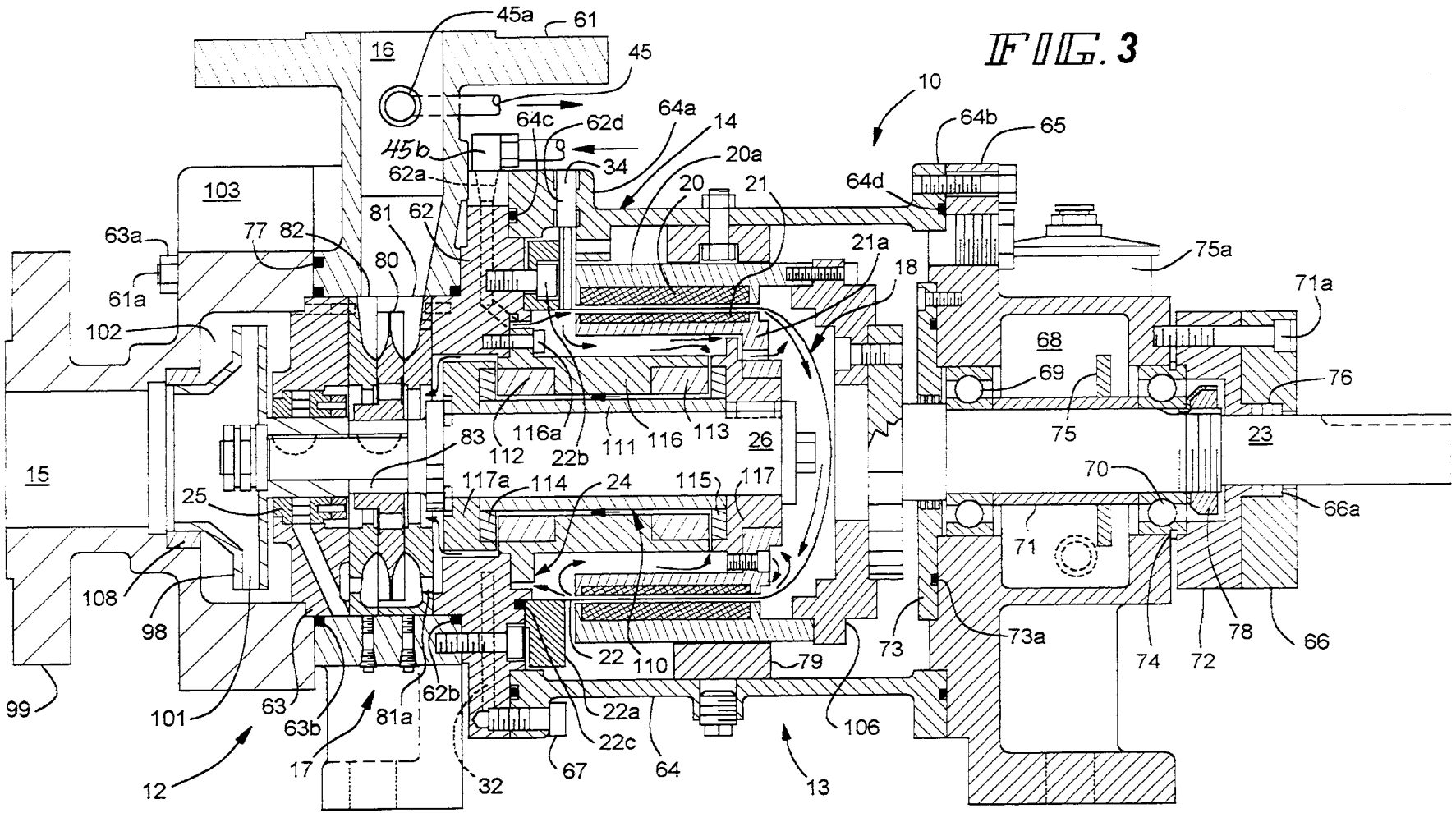
FIG. 3 is a section view of the magnetic drive pump assembly provided by the present invention.

Referring to FIGS. 1 and 3 of the drawings, the hermetically sealed magnetic drive pump assembly 10 provided by the present invention includes a pump stage 12 and a drive stage 13. The pump stage 12 is contained within a housing 14 which has a suction inlet 15 and a discharge outlet 16. The pump stage 12 includes a regenerative turbine impeller assembly 17 (FIG. 3). The drive stage 13 includes a canned magnetic drive 18, which is shown in FIG. 3. The canned magnetic drive 18 is a conventional drive mechanism including a driving magnet 20 and a driven magnet 21 which are contained within a sealed containment vessel or can 22, as is known in the art. The driving magnet 20 is coupled to a shaft 23 which is connected to a suitable drive source such as a drive motor (not shown). The driven magnet 21 is mounted on a shaft 26 which drives the impeller assembly 17 of the pump stage. The shaft 26 of the magnetic drive 18 is supported by an inboard bearing 24 and an cutboard bearing 25.

The magnetic drive pump assembly 10 includes a control system 30 which senses operating parameters of the pump assembly and causes the pump assembly to be shut down when overlimit conditions are sensed. The control system 30 includes a two stage temperature sensor 32, a two stage temperature sensor 34, a high differential pressure sensing device 35, and a low differential pressure sensing device 36. In addition, the control system includes a manually operable start switch 38, a flow switch 39 and a time delay 39*a*, a starting or holding coil 40, and a manually operable stop switch 42.

The two stage temperature sensor 32 senses the temperature of the inboard bearing 24. The two stage temperature sensor 32 is mounted within the pump housing located in the proximity of or in engagement with the inboard bearing 24 of the magnetic drive. The two stage temperature sensor 34 senses the temperature of the containment canister 22. The temperature sensor 34 is mounted within the pump housing with its sensing element engaging the containment canister 22.

The low and high differential pressure sensing devices senses the differential pressure between the discharge outlet and the suction inlet. The high differential pressure sensing device 35 has one tube 35*a* connected via a T-connector 37 to the discharge outlet 16 of the pump assembly and another tube 35*b* connected via T-connector 37' to the suction inlet 15 of the pump assembly. Similarly, the low differential pressure sensing device 36 has one tube 36*a* connected via T-connector 37 to the discharge outlet 16 of the pump assembly and another tube 36*b* connected via T-connector 37' to the suction inlet 15 of the pump assembly.

The temperature sensors 32 and 34 and the differential pressure sensing devices 35 and 36 are connected in a series electrical circuit with the holding coil 40 and the stop switch 42. The start switch 38 is connected in parallel with the low differential pressure sensing device 36. The temperature sensors 32 and 34, the differential pressure sensing devices 35 and 36 and the flow switch 39 are adapted sound or energize a warning and to interrupt the electrical circuit whenever a sensed parameter exceeds a set point value. The pump is stopped after sounding or indicating a warning whenever the electrical circuit is interrupted. When the pump is operating, the differential pressure sensing devices 35 and 36 sense the discharge pressure and the inlet pressure. The high differential pressure sensing device 35 interrupts the series circuit whenever the pressure difference increases to a predetermined or set point value. The low differential pressure sensing device 36 interrupts the series circuit whenever the pressure difference decrease to a predetermined or set point value. To start the pump, the start switch 38 is operated, temporarily overriding the differential pressure sensing devices 35 and 36. The start switch is maintained operated until the differential pressure measured by the low differential pressure sensing device 36 exceeds the set point value. At such point, the start switch 38 canister be released and the pump will continue to operate.

The control system further includes a suitable display panel 46 which includes a plurality of display devices 47 and 48 which provide a numerical display of the bearing temperature and of the canister temperature as sensored by respective sensors 32 and 34. The display panel 46 further includes numerical display devices 47*a* and 48*a* which provide a numerical display of set point values for the bearing temperature and the can temperature, respectively. In addition, the display panel includes warning lights or alarms 49 and 50 which indicate which alarm condition exists, namely, bearing temperature over limit and can temperature over limit.

The mode of operation of the control system 30 is generally described as follows. The start switch 38 is pressed to start and held in contact until fluid flow is established in the coolant lubricant piping 45 from the discharge 16. The low differential pressure sensing device or switch 36 opens at a preset differential and the high differential pressure sensing device or switch 35 opens at a preset differential. Both the low and high differential pressure sensing switches 36 and 35, respectively, operate normally closed time delay relays to energize the alarm or warning lights 49 and 50 and then after a preset time elapse open to stop the pump assembly. The flow switch 39 operates a time delay relay 39*a*, as will hereinafter be described with respect to the lubrication and coolant flow circuit, FIG. 2. The stop switch 42 is designed to override all controls and functions of the control system 30. The two stage temperature sensors 32 and 34 first sound an alarm or light indication and then will shut down the pump. For example, the two stage sensors 32 and 34 may be set to sound an alarm or light indication within the range of about 20°–50° F. above pumped product temperature and then shut down the pump when the pumped product temperature is within the range of about 40°–75° F. However, depending upon the noxious liquid pumped, the general preferred sounding or activating an alarm should occur at about 30° F. about product temperature and at about 50" above product temperature, shut down of the pump occurs.

Referring additionally to FIG. 2, the pump assembly 10 further includes a fluid circuit for providing lubrication and cooling of components of the magnetic drive 18. A portion of the processed liquid is taken off at the discharge outlet 16 through a fluid conduit 45 and is directed through a Y-strainer 51 through a flow switch 39 with a time delay 39*a* and past a magnetic plug 52 to remove magnetic particles. In addition the fluid circuit may include one or more isolation shutoff valves, such as shutoff valves 58, shown connected in the coolant fluid flow circuit adjacent to the discharge outlet and in the return line to the pumping chamber where the impeller assembly is located. A venting valve 57 is used at startup to clear the driven chamber of gas and vapor.

The mode of operation of the lubrication and coolant flow circuit of the control system 30 involves the use of shutoff valves 58 which serve to isolate the pump and control system whenever the strainer 51, flow switch 39 or magnetic plug 52 require servicing. The flow switch 39 closes when it senses 1.5 gallons per minute (gpm) and opens when the flow decreases to between about 1.0 to 0.75 gpm. The flow switch must be overridden by the start switch 38. When the flow switch 39 detects a drop in fluid flow to between about 1.0 to 0.75 gpm, the switch energizes an alarm (bell or indicator light). The time delay relay 39*a* starts its predetermined countdown, which may range between a few seconds to several minutes. At the end of the countdown, the relay 39*a* opens to stop the pump.

The filtered liquid is circulated through the containment canister 22 to cool the bearings 24 and 25, the driven magnet and to lubricate the bearings and other components of the pump magnetic drive stage. After flowing through and around the driven magnet and the bearings to the high point "B" in the canister 22, the liquid is discharged back into the pump flow path at a location "A" that is approximately at the midpoint of the flow channel. This point is at a relatively high pressure above suction pressure to prevent flashing, but less than the discharge pressure at the discharge outlet 16. In accordance with a preferred embodiment, the coolant is returned at a pressure that is 50% of the differential pressure plus suction pressure. As shown in FIG. 5, the coolant is returned at approximately midpoint the length of the channel between ports 93 and 95. However, it may be returned or released at any point where no flashing into vapor occurs. Thus, location "A" is at a point where the pressure is above the vapor pressure of the liquid.

Referring to FIG. 3, considering the magnetic drive pump assembly in more detail, the housing 14 is multipart structure which includes a case 61, an inboard cover 62, an outboard cover 63, a shell 64, a frame 65 and an outer housing cap 72. The case 61 encloses the impeller assembly 17 and defines the discharge outlet 16. The inboard cover 62 is secured to the case 61 by capscrews 62*a* and the outboard cover 63 is secured to the case 61 by case studs 61*a* and hex nuts 63*a* which retain the impeller assembly 17 within the case 61.

The canned magnetic drive pump assembly 18 is enclosed within and spaced from the shell 64 which is mounted at one end 64*a* to the case 61 by socket head capscrews 67. The frame 65 is secured to the other end 64*b* of the shell 64. Sealing between the shell and the case is provided by an o-ring 64*c*. Sealing between the shell and the frame is provided by an o-ring 64*d*. Guide bushings are located in the space between the outer surface of the support 20*a* for the driving magnet 20. The guide bushings maintains the driving magnets aligned within the driven magnet in the event of a failure of the bearings 69 or 70 which support the drive shaft 23. The frame 65 defines a bearing chamber 68 and supports an inboard bearing 69 and an outboard bearing 70 for the drive shaft 23. The inboard side of the frame 65 is closed by an inner housing cap 73. Sealing between the inner housing cap and the frame is provided by an o-ring 73*a*. The outboard side of the frame 65 is closed by the outer housing cap 72 and an adapter 66 which are secured to the frame 65 by socket head capscrews 71*a*.

Referring to the outboard side of the drive shaft 23, the drive shaft 23 is supported by an inboard ball bearing 69 and an outboard ball bearing 70 which are spaced apart axially on the shaft 23 by a shaft sleeve 71. The inboard bearing is urged against the inner housing cap 73 by the outboard bearing and the shaft sleeve with the outboard bearing being held in place by a lock nut 78 which is threaded onto the shaft 23 and a snap ring 74 which is held between the frame 65 and the outer housing cap 72, and extends into a groove in the bearing house. The bearing chamber 68 includes a slinger 75, such as a 316 stainless type slinger, on the drive shaft 23. The oil lubrication of both ball bearings is done by mist from the slinger 75 on the drive shaft 23 which is wetted by a controlled level oil pool in reservoir 75*a*.

As has already been described, the elements which make up the housing 14 of the pump assembly 10 are sealed by o-rings and the magnetic drive is contained with the containment canister 22 to provide primary containment for the processed liquid, to prevent leakage through the drive stage of the pump assembly. Secondary containment is provided by a seal 76 which is located in an annular groove 66*a* in the outer housing cap 66 to protect against environmental hazard in the event of an over pressure condition for the canister 22. The seal 76 comprises a deep ring of die-molded GRAFOIL which is located outside of the ball bearing installation which is compressed on top of the groove before the end cover is assembled with the pump. The material is installed in the groove initially to be oversized relative to the outer diameter of the shaft and in use will wear only to the extent that its inner diameter corresponds to the outer diameter of the drive shaft 23 so that a proper seal is maintained between the shaft and the pump housing 14. Projections on the outer housing cap 72 apply pressure to this packing making it conform to the groove. Additional packing may be added as desired.

Referring to FIGS. 3, 4 and 4A, the impeller assembly 17 includes an impeller 80, an inboard liner 81, and an outboard liner 82. The impeller 80 is mounted on a sleeve 83 which is clamped between the booster impeller and the shaft shoulder. The impeller 80 is movable axially along the sleeve.

The impeller 80 comprises a disc-shaped member having radially extending peripheral vanes 84 an end surface 85 a central hub 86 having a bore 87 which is adapted to receive the sleeve 83 and driven by a key or spline.

The impeller has a plurality of radially extending vanes formed at its peripheral edge. The vanes 84 are spaced apart defining a gap 84*a* between each pair of adjacent vanes. By way of example, there may be thirty-six vanes, equally spaced about the periphery of the impeller. However, the number of vanes will vary as a function of the outer diameter of the impeller.

The impeller 80 is floating or has a non-fixed location along the sleeve and shaft. The impeller has an intermediate annular portion 88 having arcuate holes 89 therein. In the circumferential intermediate portion 88 and the vanes 84, there are provided eight recesses or pressure notches 90, each having a generally D-shaped configuration oriented in the direction of rotation of the impeller, which is counterclockwise when viewed in FIG. 4. Each pressure notch has a straight line portion 90*a* and arcuate semicircular portion 90*b*. It is apparent that a greater or lesser number of recesses may be provided. The pressure notches 90 are deployed or arranged in concentric rows of eight or more notches spaced from the edge of the end surface inwardly a predetermined distance in the range, for example, of 1/16 to 3/32 of an inch. For a discussion of floating self-centering turbine impellers I refer you to my U.S. Pat. No. 5,137,418, which is assigned to the assignee of the present invention. The pressure notches are spaced apart equally at 45 or less degree separations. The radial length of the straight line portion of the notch is one-half inch, more or less, for example, for an impeller having a diameter of five and one-half inches. The other side or end surface of the disc has a corresponding pattern or configuration which is complementary to the mirror image of the pattern of recesses and grooves in the surface illustrated in FIG. 4A.

Referring to FIG. 4A, the arcuate portion 90*b* of the notch which forms the leading edge of the notch extends deeper into the surface of the disc than the straight line portion 90*a* which forms the trailing or rearward edge of the notch. The angle of inclination of the notch surface may be five degrees more or less. The radius of the curved portion is tailored to the diameter of the end surface of the disc. Which notches are illustrated as being generally "D" shaped, other shapes are possible, such as elongated generally oval shape. The main consideration is the provision of a straight line trailing edge which provide the pinch point of the notch. The impeller may be made of stainless steel, galling material or the like.

Referring to FIGS. 3 and 5, there is illustrated the inboard side plate or pair of liners of the assembly impeller assembly 17. The liner 81 is a disc-shaped member with an annular flange 92. The member has a radial notch 93 which is directed radially inwardly and communicates with a channel 94. The channel 94 communicates with a further radial notch 95. The liner has a raised annular inner surface 96, defining a thrust surface for the liner, and a central opening or aperture 97 through which the shaft 26 passes. As illustrated in FIG. 5, the liner or side plate may include the plurality of notches 90 on its surface 96, with the impeller 80 being free of notches. This prevents frictional engagement between the impeller and liner or side plate sealing surfaces. The outboard liner 82, is similar to the inboard liner 81 as to its disc-shaped portion, including raised center portion 96*a* and aperture 97*a*, but does not have an annular flange. Also, the outboard liner 82 is complementary in configuration as to the notches 93, 95 and channel 94 in its inner surface to those in the facing or opposing surface of the inboard liner 81. The notch 93 defines the fluid inlet for the regenerative impeller assembly 17. The notch 95 defines the fluid outlet for the regenerative impeller assembly 17.

Also mounted on the shaft 26 is a booster or centrifugal impeller 80 which is enclosed within a booster case 99 that is bolted to the outboard cover 63 and sealed by o-ring 77. The booster case 99 defines the suction inlet 15 of the pump assembly 10. The booster impeller 98 is coaxial with and spaced axially from the turbine impeller assembly 17 and is fixed to the shaft 26 to rotate with the shaft. The booster impeller has an annular hub which defines the suction inlet 15 and a peripheral channel 101 which communicates with an annular cavity 102 which is communicated via a passageway 103 with the inlet of the turbine impeller assembly. A bushing 108 provides a sealing surface around the suction opening.

The canned magnetic drive 18 is a conventional drive mechanism including a driving magnet 20 and a driven magnet 21 and a cylindrical containment canister 22, as is known in the art. The canister 22 has an annular flange 22*a* which facilitates securing the canister to the inboard cover 63 by capscrews 22*b*. Sealing is provided between the flange 22*a* and the inboard cover 63 by an o-ring 22*c*. The canister 22 is made of a nonmagnetic material such as stainless steel or HASTELLOY. The driving magnet 20 is carried on a support 20*a* which is connected to the drive shaft 23 by an adapter flange 106. The driving magnet 20 is cylindrical in shape and encircles the canister.

The driven magnet 21 is located within the canister 22 and is carried by a bearing assembly 110 of the magnetic drive assembly. The driven magnet 21 is cylindrical in shape and has an axial length corresponding to that of the driving magnet. The driven magnet is carried on a support 21*a* which is supported on the shaft 26 by the bearing assembly 110. The bearing assembly 110 includes an alpha centered silicon carbide a sleeve bearing 111, alpha centered silicon carbide radial bearings 112, 113 and alpha centered silicon carbide thrust bearings 114, 115. Each bearing surface is provided with lubrication grooves to assume constant flow to achieve a constant wetting on these bearing surfaces. The sleeve bearing 111 is carried by shaft 26. The radial bearings 112 and 113 are carried by a fixed support 116 which is secured to the inboard cover 62 by capscrews 116*a*. The thrust bearings 114 and 115 are carried on the sleeve bearing 111 at opposite ends thereof and are held in place between rotating annular members 117 and 117*a* which locate sleeve bearing 111 on the shaft 26. The driven magnet support 21*c* is secured to the rotating member 17.

The sleeve bearing 111 and the radial and thrust bearings 112–115 are spaced apart defining channels through which flow the coolant circulated from the outlet, through the containment canister 22 and back to the turbine impeller assembly as will be shown.

Referring to FIGS. 2 and 3, a portion of the high pressure discharge liquid is circulated through the canister of the magnetic drive. To this end, a stainless steel conduit 45 is connected from a tube connector 45*a* in the discharge outlet to a tube connector 45*b* in the pump case discharge flange. The conduit is in fluid communication with the discharge outlet 16 and the interior of the canister. The primary function of the coolant that is circulated through the magnetic drive is to control the product liquid vapor pressure from the mild heating effected by the eddy currents produced as the result of the relative motion between the driving magnet 20 and the driven magnet 21 and the canister. A secondary purpose function of the coolant circuit is to force the cooling liquid through the bearing circuit.

The conduit 45 provides a coolant flow at discharge pressure through a bore 62*a* an the inboard cover 62 of the pump to the interior of the nonmagnetic canister 22. The cooling liquid then flows around the inside surface of the canister 22 between the driven magnet 21 and the canister inside surface and also between the radial bearings 112, 113 and driven magnet support 21*a*, as indicated by the arrows in FIG. 3, and into the outboard and of the canister 22 and is finally diverted to flow between the alpha centered silicon carbide shaft sleeve bearing 111 and the alpha centered silicon carbide radial bearings 112, 113 and thrust bearings 114, 115. From there, the cooling liquid passes between the surface of the inboard cover 62 and the member 117*a* and is returned via a channel 81*a* in the inboard liner 81 to the flow stream at a pressure that is approximately 50% of the differential pressure plus suction pressure in the pump. The liquid joins the inlet flow and is moved by the impeller assembly 1 to the pump discharge outlet.

Figure 6:
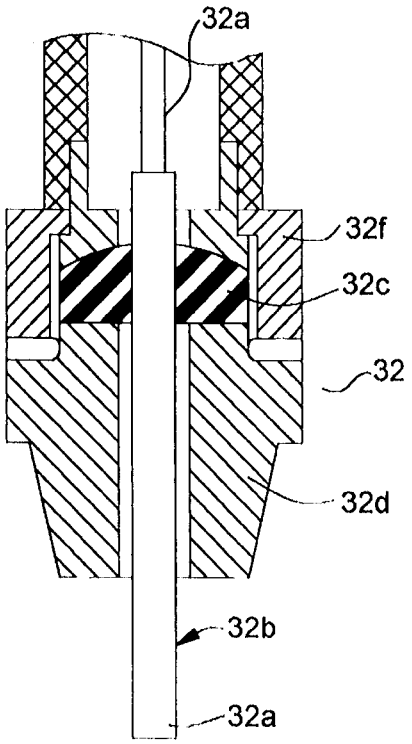
FIG. 6 is a sectional view of the temperature probe of the magnetic drive pump assembly shown in FIG. 3.

Referring now to FIGS. 1, 3 and 6, the temperature sensor 32 which senses the temperature of the inboard bearing 24 of the magnetic drive is mounted in a bore 62*d* in the inboard cover 62 to be located at the bearing 24. As shown in FIG. 6, the temperature sensor 32 comprises a thermocouple element 32*a*, including stainless steel tubing 32*b* having the thermocouple wires soldered into the tip 32*c* which at the bearing 24. The temperature sensor 32 includes a compression fitting 32*d* which facilitates mounting the sensor on the pump housing, a grommet 32*c* which holds the thermocouple element, and a standard SAE nut with a flexible conduit 32*f* which secures the grommet and thermocouple to the compression fitting and provides depth adjustment for the lip of the thermocouple element.

The thermocouple is inserted to contact a metal surface at or near the inboard bearing 24.

The temperature sensor 34 which senses the temperature of the canister is mounted in a bore 62*e* in the inboard cover to be located at the canister. The temperature sensor 34 has the same construction as temperature sensor 32 shown in FIG. 6. The tip of the thermocouple element is inserted to contact the canister, with a thin layer of insulated film between the tip and the canister.

Referring to FIGS. 1 and 3, for purposes of illustration of the operation of the pump assembly 10, it is assumed that the pump assembly is running and that the shaft 23 is being rotated, rotating the driving magnet 20 which causes the driven magnet 21 to rotate, thereby rotating the shaft 26 and the impeller disc 80 and booster impeller 98 mounted on the shaft 26.

When the pump is operating, the differential pressure sensing devices 35 and 36 sense the discharge pressure and the inlet pressure. The high differential pressure sensing device 35 interrupts the series circuit whenever the pressure difference increases to a predetermined or set point value. The low differential pressure sensing device 36 interrupts the series circuit after delay whenever the pressure difference decreases to a predetermined or set point value.

Figure 7:
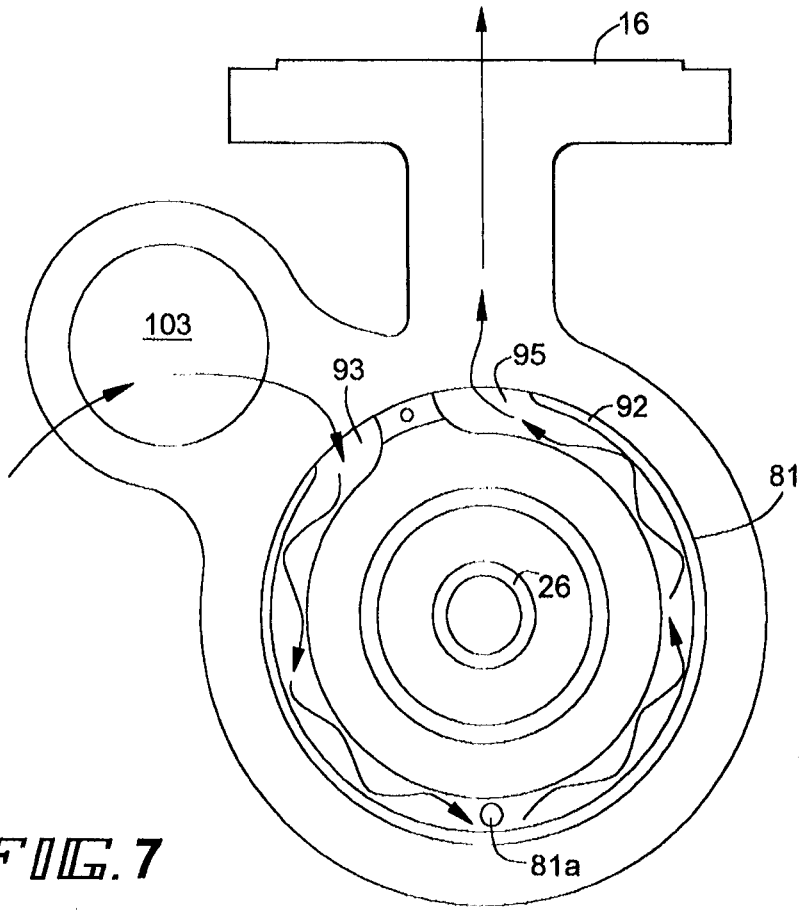
FIG. 7 is a simplified end view of the pump assembly at the inlet of the impeller stage, illustrating the fluid flow pattern.

Referring to FIGS. 1, 3 and 7, as the impeller is rotated, liquid is drawn into the suction inlet 15 and into the booster case 99 through the booster impeller into the channels 103 and is forced into the impeller assembly 17 though the inlet at notch 93 of liner 81. The pressure created in the impeller chamber moves the fluid through the impeller chamber the fluid being circulated radially inwardly and regeneratively due to the action of the rotating turbine blades in cooperation with the liners 81 and 82. This regenerative circulation increases the pressure of the liquid as it is flowing from the suction inlet 15, through the impeller assembly 17, and to the discharge outlet 16.

The conduit 45 provides a coolant flow at discharge pressure through the inboard cover 62 of the pump to the interior of the nonmagnetic can 22. The cooling liquid then flows around the inside surface of the canister 22 in the manner as described hereinafter, and along the flow notches indicated by the arrows in FIG. 3, contacting the bearings of the bearing assembly 110 and is finally diverted to flow between the shaft sleeve bearing 111 and the radial and thrust bearings, passes between surface of the inboard cover 62 and the member 117*a* and is returned via channel 81*a* in the inboard liner 81 to the flow stream at a 50% lower pressure in the pump. The liquid joins the inlet flow and is moved by the impeller assembly 17 to the pump discharge outlet 16.

If the temperature of the inboard bearing 24, as sensed by two stage temperature sensor 32, or the temperature of the canister 22, as sensed by temperature sensor 34 exceeds the set point value, then sensors cause a signal and the electrical circuit to be interrupted, shutting down the pump.

Figure 8:
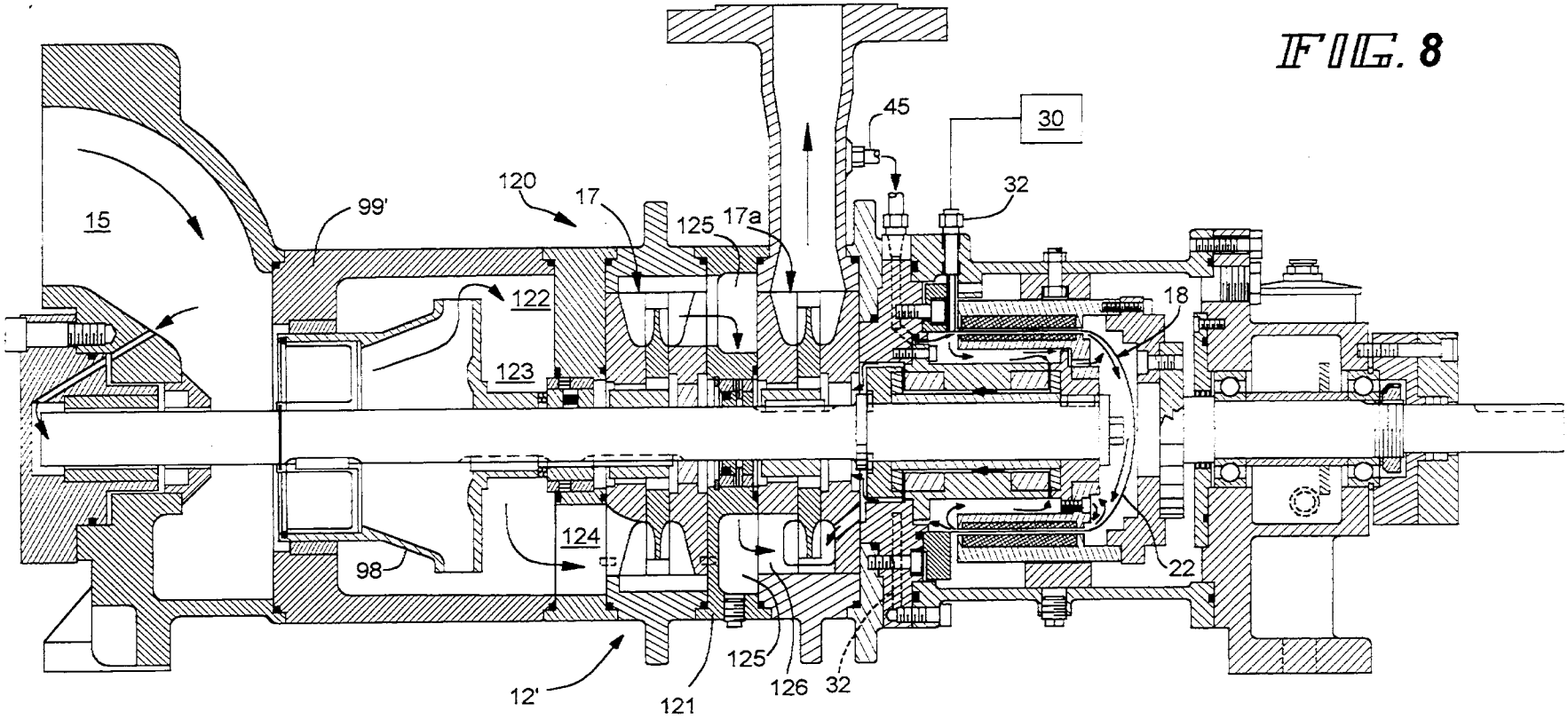
FIG. 8 is a section view of a low net positive suction head multistage, magnetic drive pump assembly provided by the present invention; and, FIG. 9 is a section view of a canister net low positive suction head multistage, magnetic drive pump assembly provided by the present invention.

Referring to FIG. 8, there is illustrated a hermetically sealed magnetic drive pump assembly 120 which includes a multistage pump 12' including two regenerative turbine impeller stages 17 an 17*a* which are connected in tandem and coupled together in fluid communication by transfer plate 121. The pump assembly 120 is similar to the pump assembly 10 and includes a canned magnetic drive stage 18, and a control system 30 and a fluid circuit for providing lubrication and cooling of components of the magnetic drive 18 in the manner which has been described for pump assembly 10. The elements of the pump stage 120 of the pump assembly 120 which are similar to elements of pump assembly 10 have been given the same reference numerals with a prime notation and elements of the pump assembly 102 which are the substantially the same as elements of pump assembly 10 have been given the same reference numerals.

The flow path for the liquid from the suction inlet 15 through the pump stage 12' to the discharge outlet 16 is as follows. The liquid is drawn through the suction inlet 15 into the booster housing 99' and is directed by the centrifugal impeller 98 radially into the upper portion 122 of the annular channel 123 and directed over a spiral path to the inlet 124 of the first impeller stage 17. The first impeller stage 17 imparts regenerative action to the liquid in the manner of impeller stage 17 for the pump assembly 10, as has heretofore been described. At the output 125 of the impeller stage 17, the liquid is redirected by the transfer plate 121 to the inlet 126 of the second stage impeller 17*a*. The second stage impeller 17*a* imparts further regenerative turbulence to the liquid which is then discharged through the discharge outlet 16 of the pump stage 120. A portion of the discharge liquid at the high discharge pressure is circulated through the magnetic drive can 22 in the manner described above for the pump assembly 10. In other aspects, the pump assembly 120 operates in the manner of pump assembly 10.

Figure 9:
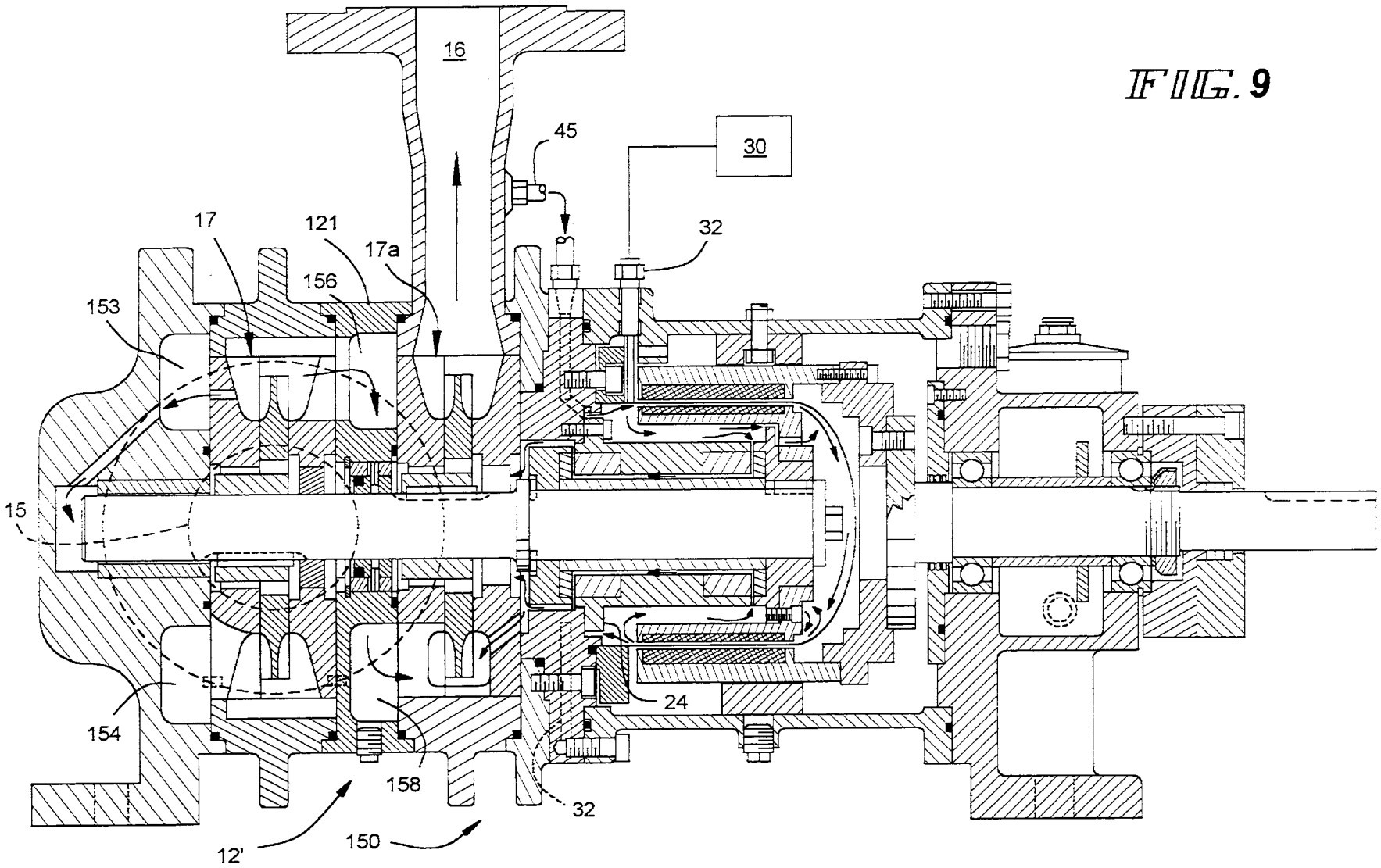

Although the multi-stage pump assembly 120 illustrated in FIG. 8, includes a booster stage including a booster impeller 98, a multi-stage magnetic drive pump 150, shown in FIG. 9, which includes regenerative turbine impellers 17 and 17*a*, the control system 30 and the coolant flow circuit for cooling and lubricating the elements of the magnetic drive may be provided without the booster stage. Referring to FIG. 9, there is illustrated a hermetically sealed magnetic drive pump assembly 150 which is similar to pump assemblies 10 and 120, but which does not include a booster impeller and thus does not provide a low net positive suction head. Accordingly, elements of the pump assembly 150 have been given the same reference numerals as corresponding elements of pump assemblies 10 and 120.

The flow path for the liquid from the suction inlet 15 through the pump stage 12' to the discharge outlet 16 is as follows. The liquid is drawn through the suction inlet 15 which is communicated with an annular channel 153 and directed to the inlet 154 of the first impeller stage 17. The first impeller stage imparts regenerative turbulence to the liquid in the manner of impeller stage 17 for pump assembly 10 as has been described. At the output 156 of the impeller stage 17, the liquid is redirected by the transfer plate 121 to the inlet 158 of the second stage impeller 17*a*. The second stage impeller 17*a* imparts further regenerative turbulence to the liquid which is then discharged through the discharge outlet 16 of the pump stage 121. A portion of the discharge liquid at the high discharge pressure is circulated through the magnetic drive can 22 in the manner described above for pump assembly 10. In other aspects, the pump assembly 150 operates in the manner of pump assembly 10 and pump assembly 150.

I claim:

1. A pump assembly for pumping volatile fluids comprising:

a housing having a suction inlet and a discharge outlet;

a pump assembly contained within said housing, said pump assembly including a pump stage and a drive stage;

said pump stage including an impeller assembly having an impeller member constructed and arranged to impart regenerative turbine flow to the fluid being pumped;

said drive stage including a bearing structure and driven magnet rotating a shaft which is operatively coupled to said impeller assembly to rotate the same;

said drive stage further including a drive magnet for rotating the driven magnet and said shaft, with said driven magnet associated with said shaft and said bearing structure having a sealed containment canister positioned thereabout and sealed to said housing;

with said shaft being operatively connected to said impeller assembly of said pump stage to rotate the same to impact regenerative turbine flow of the fluid through the pump stage;

wherein a portion of said pumped fluid exiting said discharge outlet of said pump stage is circulated through said drive stage to cool and lubricate the same and is returned to said pump stage intermediate said suction inlet and said discharge outlet; and including means for measuring the temperature of said bearing structure within said containment canister and the temperature of said containment canister.

2. The pump assembly according to claim 1 wherein said impeller member is axially floating on said shaft and includes sealing surfaces on the sidewalls thereof and adjacent mounted enclosing liner members.

3. The pump assembly according to claim 1, wherein said drive magnet is rotated by a drive shaft which is coupled to a drive motor for rotating said driven magnet, said shaft and said impeller member.

4. The drive pump assembly according to claim 3, wherein said impeller member assembly includes said impeller member and enclosing liner members positioned on either side of said impeller.

5. The pump assembly according to claim 4, wherein said enclosing liner members [includes a pair of] are casing rings having a fluid passageway means associated therewith for directing fluid from said suction inlet and from said drive stage to said impeller assembly.

6. The pump assembly according to claim 5, wherein said pump stage is a multi-stage pump.

7. The pump assembly according to claim 1, including a booster impeller located within said suction inlet portion of said housing for imparting centrifugal turbulence to the fluid to achieve low net positive suction head performance for the pump assembly.

8. The pump assembly according to claim 2, wherein said impeller member includes a plurality of recesses on each sealing surface of said impeller, with each of said recesses having an arcuate semicircular leading edge an a straight line trailing edge which defines a pinch point to prevent frictional engagement between said impeller member and said impeller assembly.

9. The pump assembly according to claim 2 wherein each of said enclosing members sealing surfaces facing said impeller includes a plurality of recesses on each sealing surface of said impeller, with each of said recesses having an arcuate semicircular leasing edge and a straight line trailing edge which defines a pinch point to prevent frictional engagement between said impeller member and said impeller assembly.

10. In a magnetic drive pump assembly for pumping a fluid and including a drive means having an outlet and an inlet and having a containment canister with a metal surface and inboard bearings structure therein, with each of the canister and bearing structure having a set point temperature of operation, including:

means for monitoring the differential temperature of the containment canister and inboard bearings structure within the magnetic drive pump assembly.

11. In a magnetic drive pump assembly according to claim 10, further including means for displaying the temperature measured and the set point temperatures of the containment canister and the inboard bearings.

12. In a magnetic drive pump assembly according to claim 10, further including switching means for disabling said pump assembly when the measured differential temperature of said containment canister and said inboard bearing set point is outside predetermined limits.

13. In a magnetic drive pump assembly according to claim 10, further including means for circulating a portion of the pumped fluid through said containment canister to at least cool the inboard bearing structure, said means defining a fluid flow passageway between said outlet and said inlet of said drive means.

14. In am magnetic drive pump assembly according to claim 13 including means cooperating with said fluid flow passageway for filtering the fluid being circulated through said containment canister.

15. The magnetic rive pump assembly according to claim 13 wherein said means for filtering includes means for removing particulate matter from said fluid.

16. The magnetic drive pump accordingly to claim 15, wherein said means for filtering comprises a magnet.

17. The magnetic drive pump assembly according to claim 13 including a vent valve in said housing for venting said passageway at startup of the pump.

18. In a magnetic drive pump assembly in accordance with claim 10 wherein said means for monitoring the differential temperature of the containment canister and the inboard bearings structure includes a thermocouple inserted to contact the metal surface adjacent the inboard bearing and a second thermocouple is inserted to contact the metal surface of the containment canister.

19. In a magnetic drive pump assembly in accordance with claim 18 wherein said second thermocouple contacting said surface of the containment can includes a thin film of insulated material positioned between said second thermocouple and said surface of the containment can.

20. The pump assembly for pumping volatile fluids comprising:

a housing having a suction inlet and a discharge outlet and defining a channel therethrough;

a pump assembly enclosed within said housing, said pump assembly including a pump stage and a drive stage;

said pump stage including an impeller constructed and arranged to impart regenerative turbine flow to the fluid being pumped;

said drive stage including a magnet drive means having a shaft which is coupled to said impeller to rotate the same;

a containment canister defining a primary enclosure which seals said magnetic drive means for containing fluids therein;

said housing defining a secondary enclosure for said pump stage and said magnetic drive assembly pump for containing fluids therein; and wherein a portion of the pumped fluid exiting said discharge outlet is circulated through said drive stage to cool and lubricate the same and is returned to said pump stage intermediately between said inlet and said discharge outlet.

21. The pump assembly of claim 20 wherein said impeller is axially floating on said shaft between enclosing members positioned on either side of said impeller.

22. The pump assembly of claim 20 wherein the circulated coolant and lubricant exiting said drive stage enters the inlet of said pumping stage at a location wherein the pressure of the coolant and lubricant exiting said drive stage is greater than the vapor pressure of the pumped fluid.

23. The pump assembly of claim 22 wherein the circulated coolant and lubricant exiting said drive stage enters the pumping stage at a location approximately midpoint of the length of the channel that defines the fluid flow through the pumping stage.

* * * * *

UNITED STATES PATENT AND TRADEMARK OFFICE

CERTIFICATE OF CORRECTION

PATENT NO. : 5,525,039
DATED : June 11, 1996
INVENTOR(S) : Leonard J. Sieghartner It is certified that error appears in the above-indentified patent and that said Letters Patent is hereby corrected as shown below:

Column 2, line 52, delete "boaster regeneration impellers" insert --booster and regenerative impellers --.

Column 4, line 19, delete "can" insert -- canister --;
Column 5, line 14, delete "canister" insert -- can --;
line 22, delete "can" insert -- canister --;

line 52, delete "50" insert -- 50° --;
Column 10, line 42, delete "can" insert -- canister --;

I Claim

Column 12, line 58 & 59, after "said impellers" insert --member --.

Signed and Sealed this

Twelfth Day of November, 1996

Bruce Lehman

*Attest:*

BRUCE LEHMAN

*Attesting Officer*

*Commissioner of Patents and Trademarks*